US005348286A

United States Patent [19]

Buck

[11] Patent Number: 5,348,286

[45] Date of Patent: Sep. 20, 1994

[54] DEVICE FOR CONTROLLING AN INDIVIDUAL SEPARATION OF SHEETS INCORRECTLY SEPARATED FROM A SHEET PILE

[75] Inventor: Helmut Buck, Schriesheim, Fed. Rep. of Germany

[73] Assignee: Heidelberger Druckmaschinen AG, Heidelberg, Fed. Rep. of Germany

[21] Appl. No.: 124,168

[22] Filed: Sep. 20, 1993

[30] Foreign Application Priority Data

Sep. 18, 1992 [DE] Fed. Rep. of Germany ..... 4231261

[51] Int. Cl.[5] ..... B65H 7/12

[52] U.S. Cl. ..... 271/263; 271/105; 271/107

[58] Field of Search ..... 271/100, 262, 263, 20, 271/104, 105, 106

[56] References Cited

U.S. PATENT DOCUMENTS

| | | | |
|---|---|---|---|
| 3,744,787 | 7/1973 | Morrison | 271/263 X |
| 3,885,780 | 5/1975 | Morrison | 271/263 X |
| 3,993,303 | 11/1976 | Riedl et al. | 271/26 |
| 4,462,585 | 7/1984 | Gieson et al. | 271/263 X |
| 4,531,726 | 7/1985 | Bornstein | 271/263 |
| 4,533,133 | 8/1985 | Hams | 271/9 |
| 4,697,246 | 9/1987 | Zemke et al. | 271/263 X |
| 4,728,097 | 3/1988 | Vandersyde et al. | 271/263 X |

FOREIGN PATENT DOCUMENTS

| | | |
|---|---|---|
| 1200842 | 4/1966 | Fed. Rep. of Germany . |
| 2606848 | 9/1977 | Fed. Rep. of Germany . |
| 2940631 | 4/1981 | Fed. Rep. of Germany . |
| 4037377 | 5/1992 | Fed. Rep. of Germany . |
| 98822 | 7/1973 | German Democratic Rep. . |
| 92/09924 | 6/1992 | PCT Int'l Appl. . |

*Primary Examiner*—Robert P. Olszewski
*Assistant Examiner*—Carol Lynn Druzbick
*Attorney, Agent, or Firm*—Herbert L. Lerner; Laurence A. Greenberg

[57] ABSTRACT

Device for controlling an individual separation of sheets incorrectly separated from a sheet pile, including a lifting device for lifting an uppermost sheet of the sheet pile so as to feed it to a machine associated therewith, includes a structure having parts of a contactless measuring arrangement insertable between the lifted sheet and the remainder of the sheet pile for measuring the thickness of the lifted sheet, and a circuit arrangement connected to the lifting device and the measuring arrangement for evaluating signals of the measuring arrangement regarding a presence of double or multiple sheets and generating a switching signal for starting or stopping the operation of the lifting device, the structure being formed as a bifurcated contact foot having two legs and a scanning gap defined therebetween, each of the legs, respectively, including parts of the measuring arrangement for measuring the sheet thickness and, in a measuring position of the measuring arrangement, one of the legs being inserted between the lifted uppermost sheet, at a marginal region thereof, and the sheet pile remainder, the other of the legs being disposed above the lifted sheet, and the sheet being received in the scanning gap.

6 Claims, 3 Drawing Sheets

DEVICE FOR CONTROLLING AN INDIVIDUAL SEPARATION OF SHEETS INCORRECTLY SEPARATED FROM A SHEET PILE

The invention relates to a device for controlling an individual separation or singling of sheets incorrectly separated from a sheet pile. The device is applicable to sheet-fed printing machines or other sheet-processing machines wherein sheets are singled or individually separated from a neatly or regularly arranged sheet pile and supplied to the machine.

The invention is applicable to the individual separation of sheets made of paper materials, plastics or metallic materials.

Control devices have become known heretofore for preventing incorrect supplying or feeding of individually separated or singled sheets to a machine, the control devices having sensors or detectors which react to the absence of sheets, the presence of faulty or erroneous sheets, or the feeding or separation of more than a single sheet. The signals of the sensors or detectors are processed in the control device so that, upon demand or necessity, the operation of the individually separating or singling device can be stopped, the further feeding of sheets can be prevented, or the entire machine can be placed out of operation.

In a device for detecting double sheets disclosed in the published German Patent Document 29 40 631 A1, there is provided a contactless measuring arrangement for measuring actual sheet thickness. The measuring arrangement is of bipartite construction, one of the parts thereof being provided above and the other of the parts thereof below a lifted uppermost sheet of a sheet pile. The lower part of the measuring arrangement, which is formed of a phototransmitter or receiver, is disposed on a swingable component, whereas the upper part of the measuring arrangement, which cooperates with the phototransmitter or receiver, is rigidly attached to a machine frame. If the actual sheet thickness determined by the measuring arrangement deviates from a nominal or reference sheet thickness by a defined or given amount, at least one of the sheet-conveying means of the sheet-processing machine can be switched off.

The foregoing construction has proved disadvantageous with respect to the one part of the measuring arrangement being movable relative to the other part of the measuring arrangement. In order to bring the lower part of the measuring arrangement into the measuring position thereof, the lower part has to be swung between the lifted sheet and the remaining sheet pile each time after a respective uppermost sheet has been lifted. A measurement of the sheet thickness can be performed only after the swung part has come to rest in the measuring position thereof, thereby prolonging the measuring time. Furthermore, certain residual vibrations remain between the lower part and the upper part of the measuring arrangement due to shaking by the machine, thereby restricting measurement accuracy. The use of a simple optoelectronic measuring arrangement, which operates in accordance with the so-called absorption method, fails with respect to the singling or individual separation and transport of sheets formed of opaque material or of material having a low transmission coefficient.

It is accordingly an object of the invention to provide a control device of the foregoing general type having sensors or detectors which react to double sheets or multiple sheets, and wherein the measuring velocity existing during the measurement of the sheet thickness does not affect the velocity existing during the sheet singling or individual separation, and wherein the accuracy of measurement is improved.

With the foregoing and other objects in view, there is provided, in accordance with the invention, a device for controlling an individual separation of sheets incorrectly separated from a sheet pile, including a lifting device for lifting an uppermost sheet of the sheet pile so as to feed it to a machine associated therewith, and comprising means including parts of a contactless measuring arrangement insertable between the lifted sheet and the remainder of the sheet pile for measuring the thickness of the lifted sheet, and a circuit arrangement connected to the lifting device and the measuring arrangement for evaluating signals of the measuring arrangement regarding a presence of double or multiple sheets and generating a switching signal for starting or stopping the operation of the lifting device, the means being constructed as a bifurcated contact foot having two legs and a scanning gap defined therebetween, each of the legs, respectively, including parts of the measuring arrangement for measuring the sheet thickness and, in a measuring position of the measuring arrangement, one of the legs being inserted between the lifted uppermost sheet, at a marginal region thereof, and the sheet pile remainder, the other of the legs being disposed above the lifted sheet, and the sheet being received in the scanning gap. Because each of the legs carries parts of the measuring arrangement for measuring the sheet thickness, and the legs are disposed rigidly with respect to one another at the contact foot, the parts of the measuring arrangement do not perform any motion relative to one another. The vibration behavior of the machine and of the individually separating or singling device, respectively, and that of the contact foot do not influence the measuring result. The measuring process can be started even during the insertion and pivoting, respectively, of the contact foot, so that considerable time is available for measurements. In a further development of the invention, the lower leg of the contact foot may have a suction device which may be used to hold back a lower sheet by suction, if two sheets have been lifted at the same time, while permitting the uppermost lifted sheet to be conveyed to the machine despite an incorrect sheet separation. Furthermore, the suction device may be used to move the lifted sheet or sheets into contact with a defined bearing region, thus reducing the occurrence of faults caused by mis-aligned sheets in the scanning gap.

Thus, in accordance with another feature of the invention, the contact foot is pivotally mounted.

Moreover, in accordance with a further feature of the invention, the one leg insertable between the lifted uppermost sheet and the sheet pile remainder is lower than the other leg and carries a suction device formed with suction openings terminating in the scanning gap.

In accordance with an added feature of the invention, the contact foot is connected to a blower device for fanning the sheets on the sheet pile. Thus, the blower device may be moved together with the contact foot and, in so doing, the nozzles of the blower device may be directed onto the sheet edges in the upper region of the sheet pile.

In accordance with an additional feature of the invention, the measuring arrangement for measuring the sheet thickness includes parts of a contactless measuring arrangement for measuring the height of the sheet pile.

In accordance with a concomitant feature of the invention, each of the legs carries respective transmitter and receiver devices of an ultrasonic thickness measuring system.

If, for example, each leg of the contact foot of a transmitter/receiver device has an ultrasonic thickness measuring system, the transmitter/receiver device may act bi-directionally by being directed, on the one hand, onto the underside of the lifted sheet and, on the other hand, onto the uppermost sheet of the remaining sheet pile. Due to this multiple function of the ultrasonic thickness measuring system, signals for activating or controlling a pile-lifting device may be obtained.

Other features which are considered as characteristic for the invention are set forth in the appended claims.

Although the invention is illustrated and described herein as embodied in a device for controlling an individual separation or singling of sheets incorrectly separated from a sheet pile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
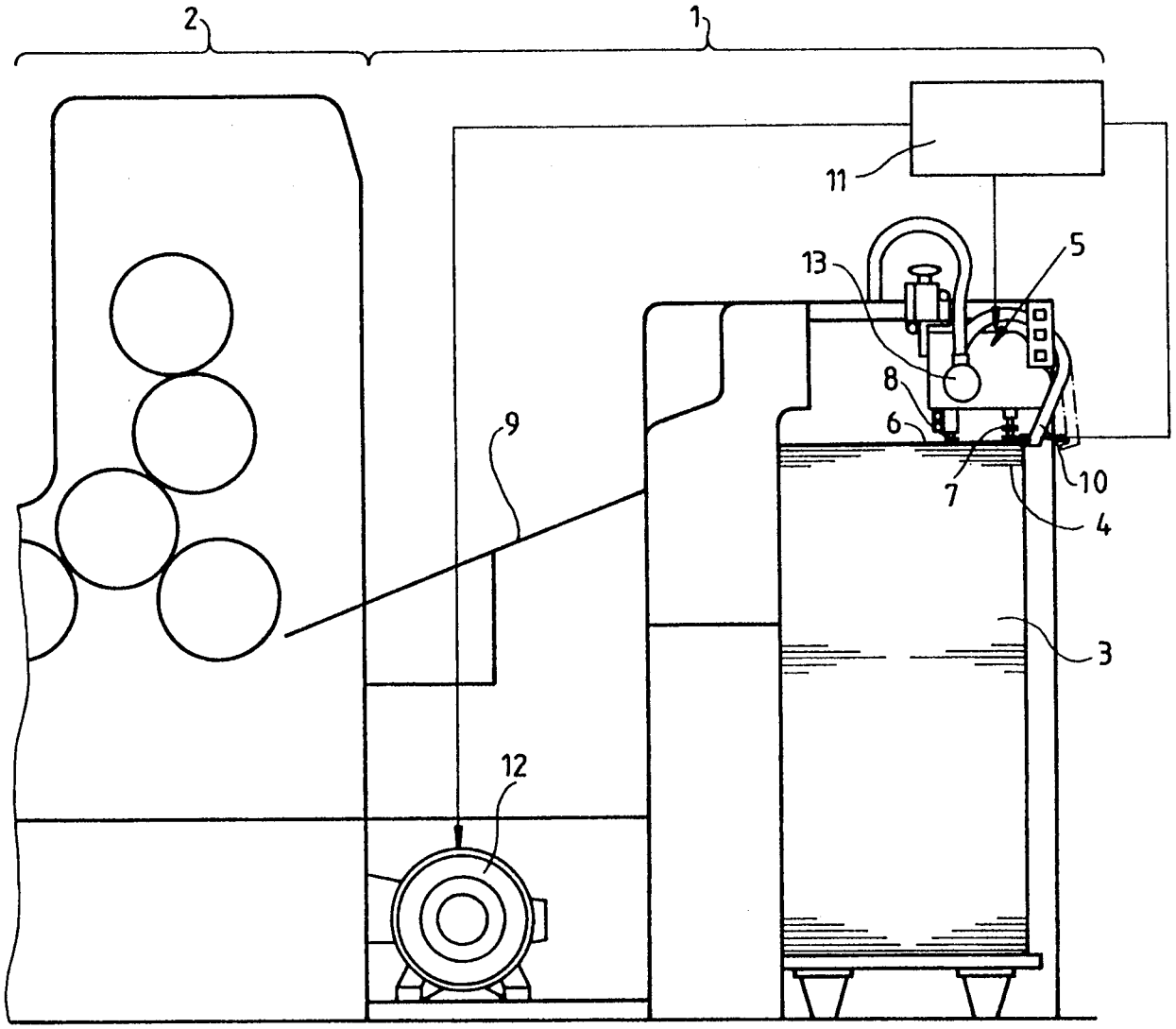
FIG. 1 is a diagrammatic side elevational view of a sheet feeder of a sheet-fed printing machine incorporating the control device according to the invention.
Figure 2:
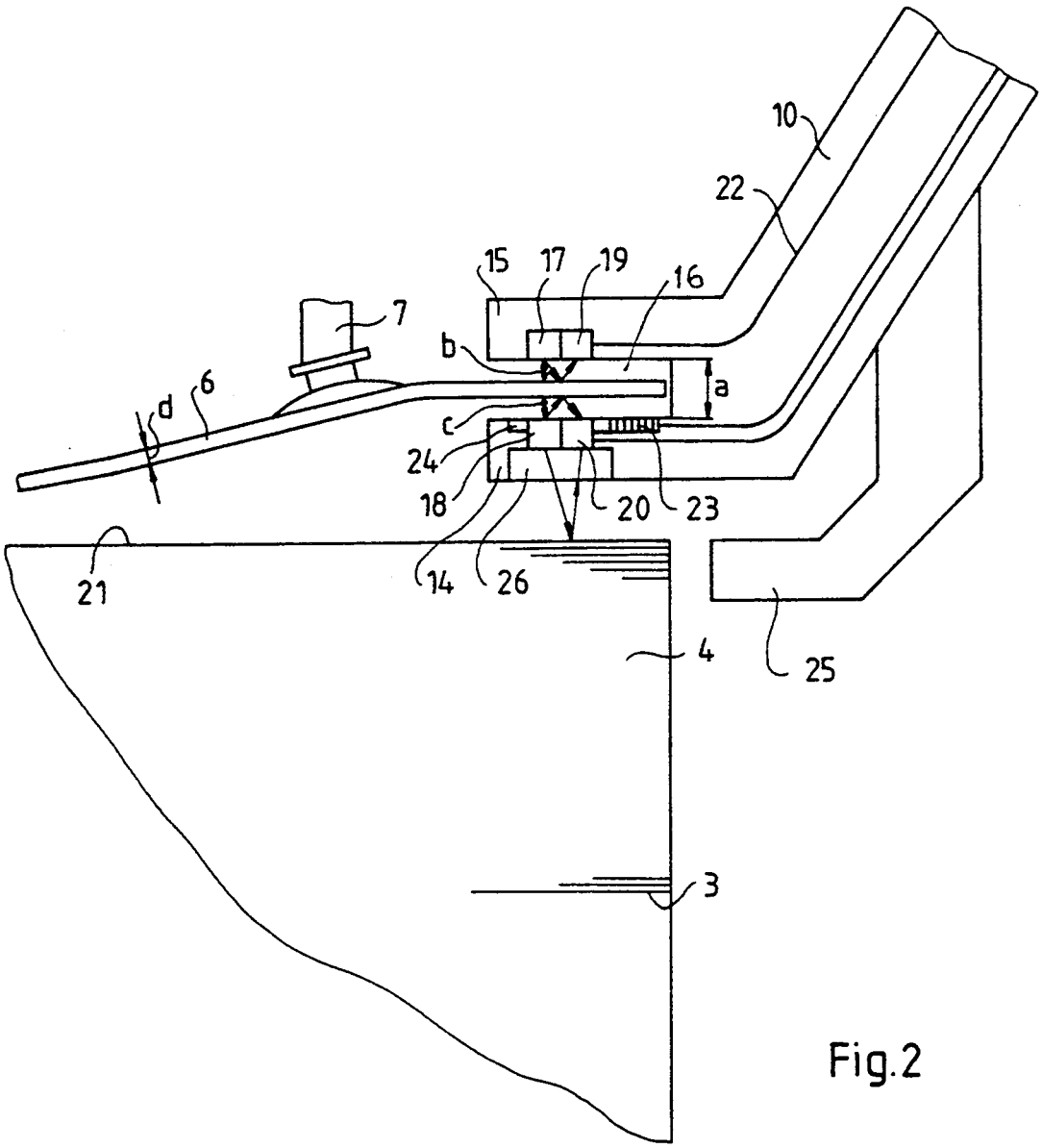
FIG. 2 is a much-enlarged fragmentary view of FIG. 1 showing the control device in greater detail.

Referring now to the drawings and, first, particularly to FIG. 1 thereof, there is shown therein a feeder 1 of a sheet-fed printing machine 2. By means of a suction head the sheets 4 are individually separated from or singled out of a sheet pile 3. For this purpose, the uppermost sheet is lifted, in the region of the trailing edge thereof, by means of lifting suckers 7 and transported by means of pull or forwarding suckers 8 towards a feeding table 9. In order to prevent the feeding of more than one sheet 4 at one time to the sheet-fed printing machine 2, the feeder 1 is provided with a control device which is primarily formed of a pivotally-mounted contact foot 10 carrying a measuring arrangement for measuring the thickness of the lifted sheet 6. The measuring arrangement has a measuring-signal output which is connected to a conventional circuit arrangement 11 (FIG. 2) for evaluating the measuring signals. Outputs of the circuit arrangement 11 are connected to a drive such as a motor 12 the sheet-fed printing machine 2 and to a conventional control element 13 for controlling the suction head 5. The contact foot 10, as shown in FIG. 2, is of bifurcated construction, having two legs 14 and 15 and a scanning gap 16 formed therebetween. In each leg 14, 15, a respective transmitter 17, 18 and a respective receiver 19, 20 for ultrasonic waves are provided. The transmitter 17 and the receiver 19 provided in the upper leg 15, as shown in FIG. 2, are directed onto the upper side of the lifted sheet 6. The transmitter 18 and the receiver 20, on the other hand, act upon the underside of the lifted sheet 6 and upon the upper surface of an uppermost sheet 21 of the remaining sheet pile 3.

Figure 3:
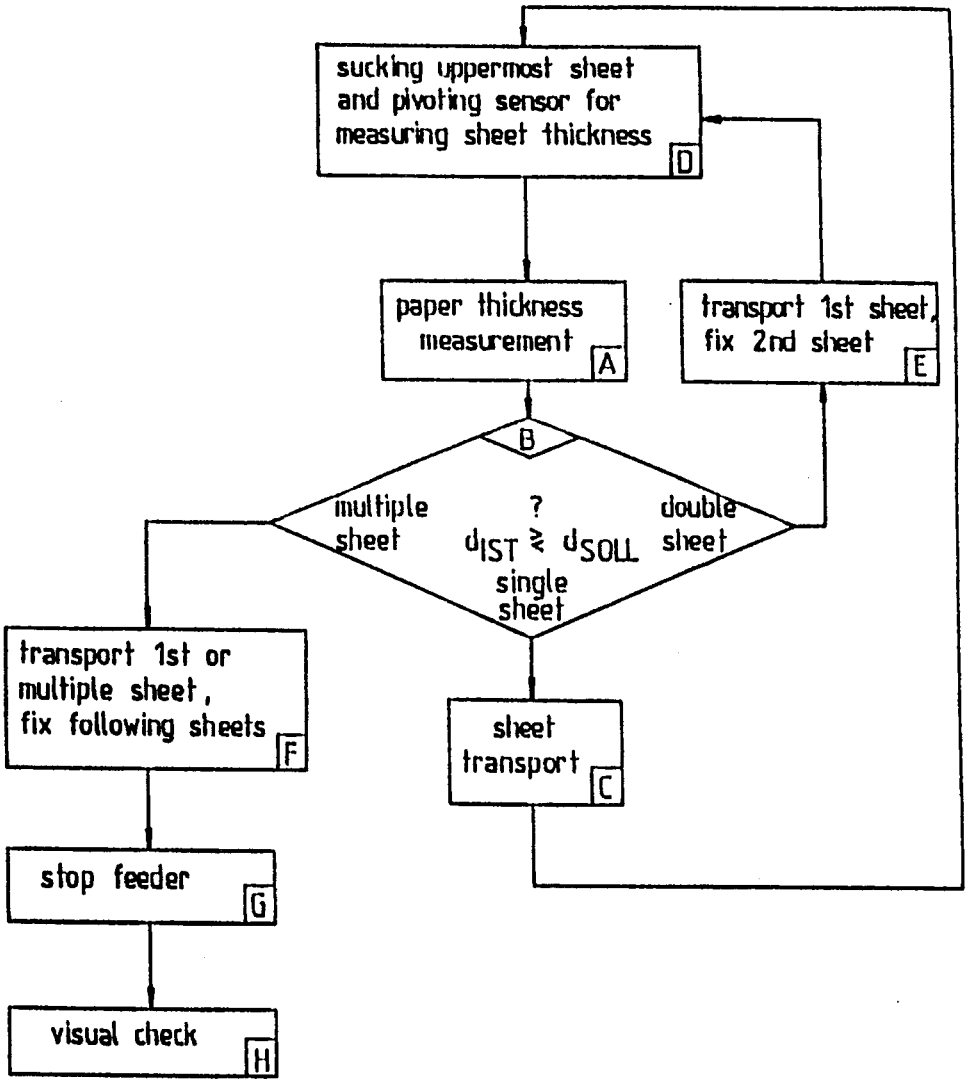
FIG. 3 is a flow chart of the operation of a circuit arrangement forming part of the control device according to the invention.

Referring now to the flow chart of FIG. 3, after the contact foot 10 has been swung into the measuring position thereof, a paper thickness measurement is performed (note Stage A).

From signals received from the receiver 19, 20, the actual thickness $d_{IST}$ is compared with a nominal or reference thickness $d_{SOLL}$ (note Stage B).

If a single sheet 6 is detected as a result of this comparison, the circuit arrangement 11 then generates a signal so that the sheet is transported farther in the direction of the feeding table 9 by the forwarding suckers 8 (note Stage C). Thereafter, the next sheet 6 can be lifted from the sheet pile 3 and the contact foot 10 can be pivoted in for a new measurement (note Stage D).

If a double sheet is detected in the result of the aforementioned comparison, then only the upper sheet 6 thereof is transported to the feeding table 9, whereas the lower sheet of the double sheet is held fast by the suction device 23 (note Stage E). In the next cycle, the lower sheet of the double sheet is again lifted by suction and the thickness thereof measured (note Stages D and A).

If the lifting of several sheets is detected in the result of the comparison, then the upper sheets 6 are transported farther and only the lowermost sheet is held fast by the suction device 23 (note Stage F). The drive 12 is simultaneously switched off, so that no further sheets 6 run into the machine (note Stage G). In such a case, the pressman or other personnel has the possibility of visually checking whether merely a double sheet with an air cushion intermediate the sheets or whether more than two sheets 6 were lifted (note Stage H). If more than two sheets were involved, the pressman or other personnel would then remove the troublesome sheets 6 from the feeding table 9, so as to return, without any further measures, to normal operation of the machine (note Stage C).

The control device operates in a manner described hereinafter:

The initially uppermost sheet 6 is sucked by the lifting sucker 7 and the forwarding sucker 8 and thereby singled out or separated from the sheet pile 3. The contact foot 10 is then swung from the position thereof shown in phantom in FIG. 1 into the measuring position thereof shown in solid lines above the sheet pile 3. The instant the lifted sheet 6 is scanned by the ultrasonic thickness measuring system, the measurement of the sheet thickness is initially performed, in accordance with the so-called reflection principle, by a determination of the distances b and c between the respective transmitter 17 and 18 and the respective receivers 19 and 20, and the upper side and underside of the sheet 6. When the parallel scanning gap 16 has a width a, the actual thickness d of the sheet 6 is calculated from the equation $d=a-(b=c)$. The signals for the actual thickness d are fed via lines 22 to the circuit arrangement 11, wherein the actual thickness d is compared with a nominal or reference thickness. If, by a simultaneous lifting of more than a single sheet 6, the actual thickness d exceeds the reference thickness by a defined amount, the circuit arrangement 11 transmits a signal to the control element 13 of the suction head 5 so that the operation of the lifting sucker 7 and the forwarding sucker 8 is interrupted. In addition thereto, the drive of the sheet-fed printing machine 2 may be rendered inoperative.

If two sheets are lifted simultaneously, a signal may be transmitted to the control element 13 of the suction head 5, thereby setting into operation an additional suction device 23 located in the lower leg 14 of the contact foot 10. This ensures the retention of the lower sheet of the two lifted sheets, without having to interrupt the singling or individual separating process and the operation of the sheet-fed printing machine 2. The uppermost sheet 6 may be transported farther towards the feeding table 9 by means of the forwarding suckers 8.

Even when error-free singling or individual sheet separation is taking place, the additional suction device 23 may be set into operation; in so doing, each sheet 6 is then brought into contact with a defined bearing or support surface 24 before the sheet thickness is measured, so that mutually identical measuring conditions are provided for all of the sheets 4, 6, thereby improving the accuracy of measurement.

The contact foot 10 may be connected to a blower device 25 which is directed onto the sheet edges in the upper region of the sheet pile 3, thereby effecting a fanning of the sheets in the sheet pile 3.

The transmitter 18 and the receiver 20 may also be used additionally for scanning the height of the sheet pile 3. For this purpose, the lower leg 14 is formed with an opening 26 through which an ultrasonic distance measurement may be performed.

The foregoing is a description corresponding in substance to German Application P 42 31 261.2, dated Sep. 18, 1992, the International priority of which is being claimed for the instant application, and which is hereby made part of this application. Any material discrepancies between the foregoing specification and the aforementioned corresponding Germnan application are to be resolved in favor of the latter.

I claim:

1. Device for controlling an individual separation of sheets incorrectly separated from a sheet pile, including a lifting device for lifting an uppermost sheet of the sheet pile so as to feed it to a machine associated therewith, and comprising means including first and second sets of parts of a contactless measuring arrangement, the first set of parts being insertable between the lifted sheet and a remainder of the sheet pile, for measuring a thickness of the lifted sheet, and a circuit arrangement connected to the lifting device and said measuring arrangement for evaluating signals of the measuring arrangement regarding a presence of double or multiple sheets and generating a switching signal for starting or stopping the operation of the lifting device, said means being constructed as a bifurcated contact foot having two legs and a scanning gap defined therebetween, each of said legs, respectively, including one of said first and second sets of parts of said measuring arrangement for measuring the sheet thickness and, in a measuring position of said measuring arrangement, one of said legs being inserted between the lifted uppermost sheet, at a marginal region thereof, and the sheet pile remainder, the other of said legs being disposed above the lifted sheet, and the sheet being received in the scanning gap.

2. Device according to claim 1, wherein said contact foot pivotally mounted.

3. Device according to claim 1, wherein said one leg insertable between the lifted uppermost sheet and the sheet pile remainder is lower than said other leg and carries a suction device formed with suction openings terminating in said scanning gap.

4. Device according to claim 1, wherein said contact foot connected to a blower device for fanning the sheets on the sheet pile.

5. Device according to claim 1, wherein said measuring arrangement for measuring the sheet thickness includes a third set of parts of the contactless measuring arrangement for measuring the height of the sheet pile.

6. Device according to claim 5, wherein each of said legs carries respective transmitter and receiver devices of an ultrasonic thickness measuring system.

* * * * *